US008052130B2

(12) United States Patent
Huang

(10) Patent No.: US 8,052,130 B2
(45) Date of Patent: Nov. 8, 2011

(54) POWER-ACTUATED VISE APPARATUS

(76) Inventor: Jui-Ming Huang, Taichung Hsien (TW)

( * ) Notice: Subject to any disclaimer, the term of this patent is extended or adjusted under 35 U.S.C. 154(b) by 983 days.

(21) Appl. No.: 11/967,447

(22) Filed: Dec. 31, 2007

(65) Prior Publication Data

US 2008/0157454 A1 Jul. 3, 2008

(30) Foreign Application Priority Data

Jan. 2, 2007 (TW) ..... 96100052 A

(51) Int. Cl.
*B25B 1/10* (2006.01)

(52) U.S. Cl. ..... 269/244; 269/44; 269/45; 269/216; 269/222

(58) Field of Classification Search ..... 269/244, 269/216, 222, 177, 277, 43, 45
See application file for complete search history.

(56) References Cited

U.S. PATENT DOCUMENTS 3,063,708 A * 11/1962 Wollenhaupt ..... 269/216
3,758,097 A * 9/1973 Newswanger ..... 269/27
3,815,889 A * 6/1974 Weber ..... 269/28
3,829,075 A * 8/1974 Dziuballe et al. ..... 269/28
4,418,899 A * 12/1983 Zimmermann et al. ..... 269/32
4,605,208 A * 8/1986 Durham ..... 269/32
4,736,927 A * 4/1988 Clancy ..... 254/93 R
4,770,401 A * 9/1988 Donaldson ..... 269/249
4,775,135 A * 10/1988 Leibinger et al. ..... 269/303
5,133,536 A * 7/1992 Goodman ..... 269/25
5,893,551 A * 4/1999 Cousins et al. ..... 269/43
6,206,354 B1 * 3/2001 Lin ..... 269/43
6,585,247 B2 * 7/2003 Mattox et al. ..... 269/244
6,598,867 B2 * 7/2003 Martinez ..... 269/43
6,698,740 B1 * 3/2004 Slagle ..... 269/277
7,000,911 B2 * 2/2006 McCormick et al. ..... 269/239
7,121,539 B2 * 10/2006 McCormick et al. ..... 269/239
7,293,765 B2 * 11/2007 Hooper ..... 269/246

* cited by examiner

*Primary Examiner* — George Nguyen
(74) *Attorney, Agent, or Firm* — Duane Morris LLP

(57) ABSTRACT

A power-actuated vise apparatus includes a first jaw which is disposed on a base, and a second jaw which is supported by a carrier to be movable in a longitudinal direction by an angular force in an initial course. The carrier is further pressed by a linear force in a subsequent course to bring the second jaw into tightened engagement with a workpiece against the first jaw. A servo control mechanism is disposed to drive a torque transmitting member so as to transmit a torque force. A force coupler unit is configured to couple the torque transmitting member to the carrier and to take up the torque force from the torque transmitting member to result in generation of the angular force and the linear force.

14 Claims, 6 Drawing Sheets

POWER-ACTUATED VISE APPARATUS

CROSS-REFERENCE TO RELATED APPLICATION

This application claims priority of Taiwanese Application No. 096100052, filed on Jan. 2, 2007.

BACKGROUND OF THE INVENTION

1. Field of the Invention

This invention relates to a power-actuated vise apparatus, more particularly to a power-actuated vise apparatus which has a servo control mechanism for servo-controlling movement of a movable jaw in a working procedure.

2. Description of the Related Art

A conventional vise apparatus generally includes a fixed jaw secured on a base, a movable jaw slidable relative to the fixed jaw, a threaded bolt coupled to the movable jaw, and a handling rod connected to the threaded bolt. In operation, the user grips the handling rod to rotate the threaded bolt so as to permit movement of the movable jaw for tightening and loosening a workpiece between the jaws.

It is desirable to provide a power-actuated vise apparatus for use with an automatic device, such as a robot, to perform quick and steady operation.

SUMMARY OF THE INVENTION

The object of the present invention is to provide a power-actuated vise apparatus which can be servo-controlled for use with an automatic device to perform quick and steady operation.

According to this invention, the power-actuated vise apparatus includes a clamping unit, a servo control mechanism, a torque transmitting member, and a force coupler unit. The clamping unit includes a base which defines a guideway that extends in a longitudinal direction and that has opposite first and second ends, a first jaw which is disposed on the base proximate to the first end, a second jaw which is disposed to be movable in the longitudinal direction between engaged and disengaged positions, and a carrier which is disposed to support the second jaw. The carrier is driven by an angular force to move the second jaw along the guideway between the engaged and disengaged positions in an initial course. The carrier is further pressed by a linear force along the guideway in a subsequent course to bring the second jaw into tightened engagement with a workpiece against the first jaw. The servo control mechanism is disposed to deliver a torque. The torque transmitting member is driven by the servo control mechanism to transmit the torque force. The force coupler unit is configured to couple the torque transmitting member to the carrier and to take up the torque force from the torque transmitting member to result in generation of the angular force and the linear force.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
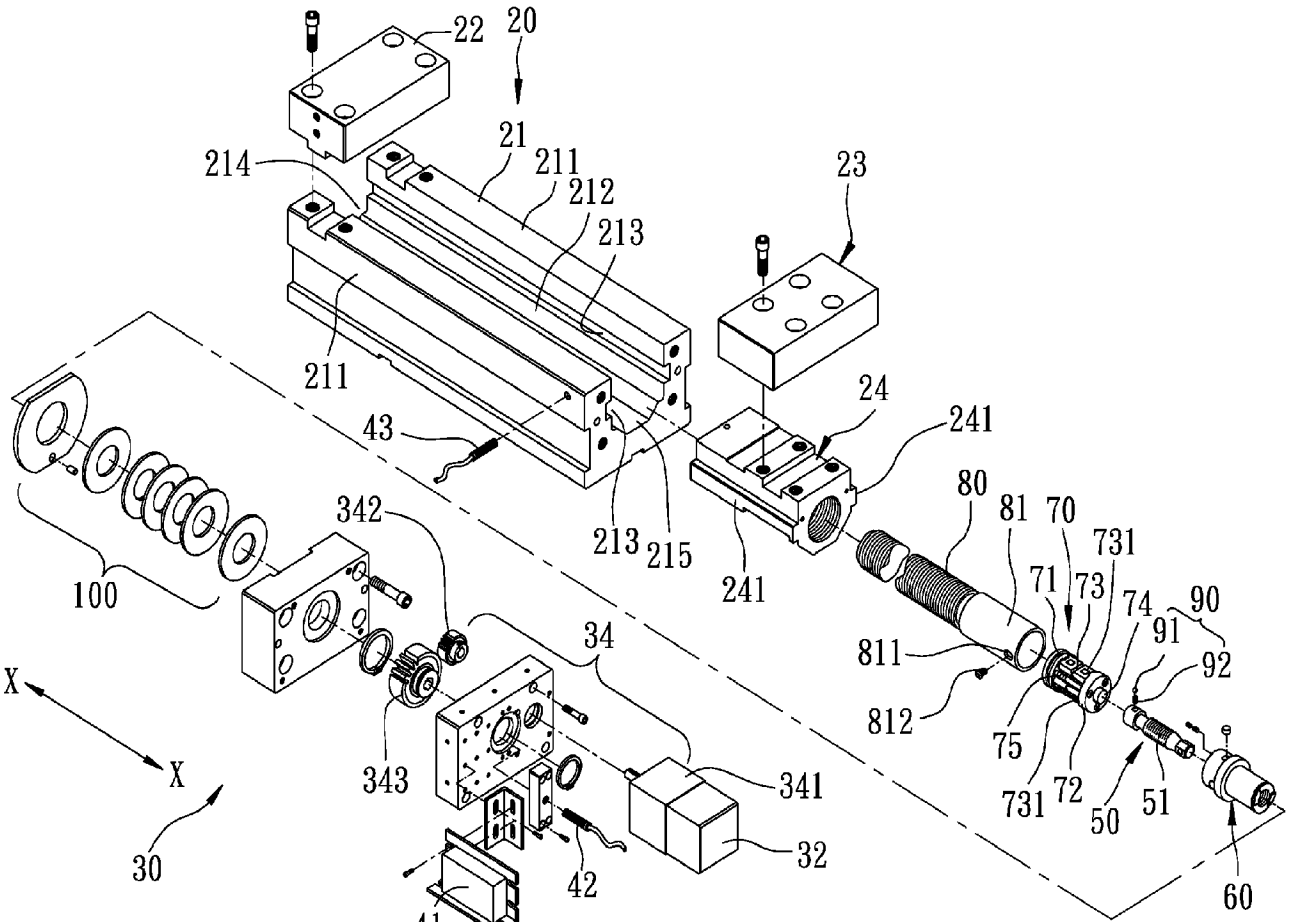
FIG. 1 is an exploded perspective view of the preferred embodiment of a power-actuated vise apparatus according to this invention.
Figure 2:
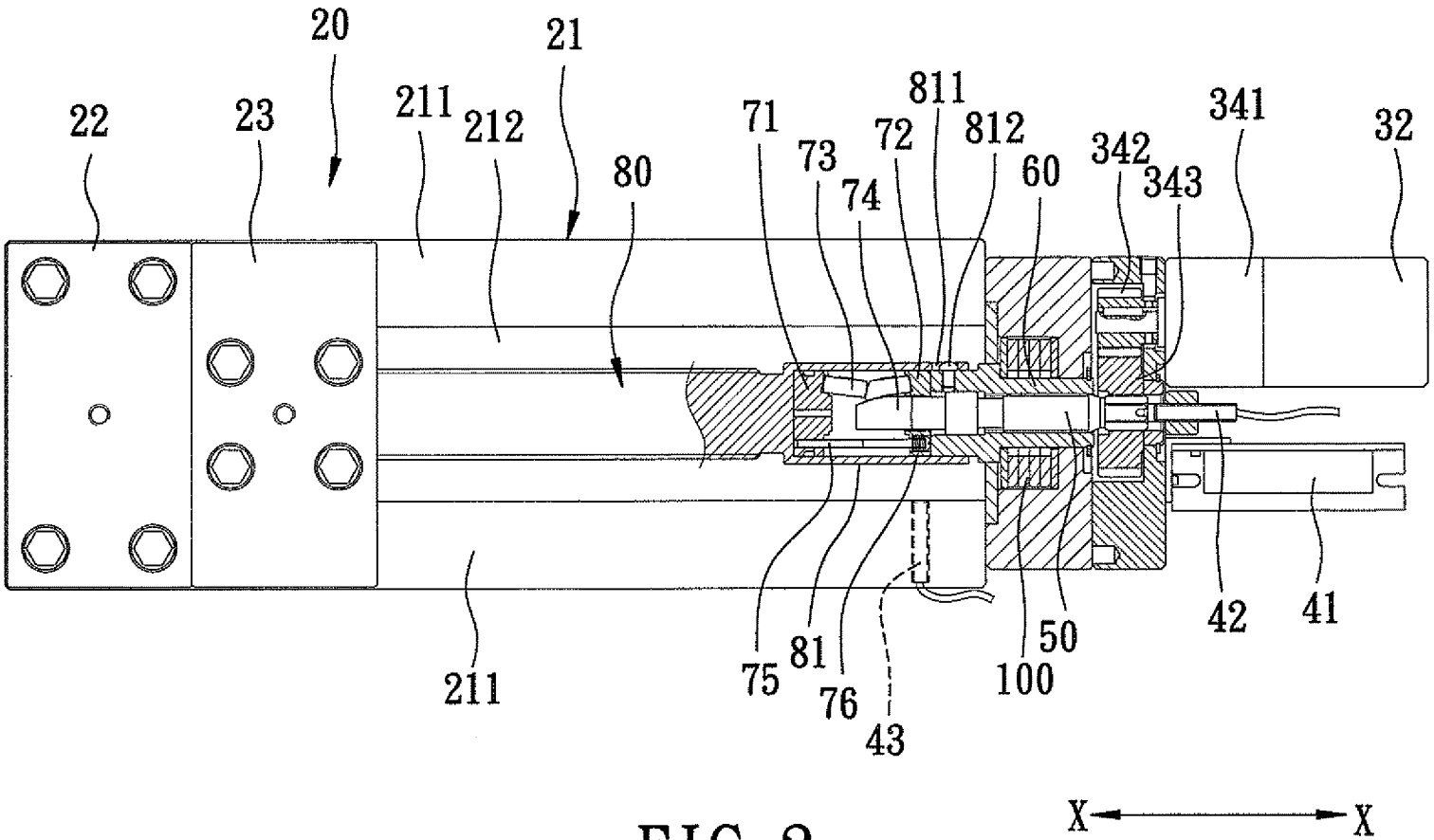
FIG. 2 is a partly sectional view of the preferred embodiment in a tightening state.
Figure 3:
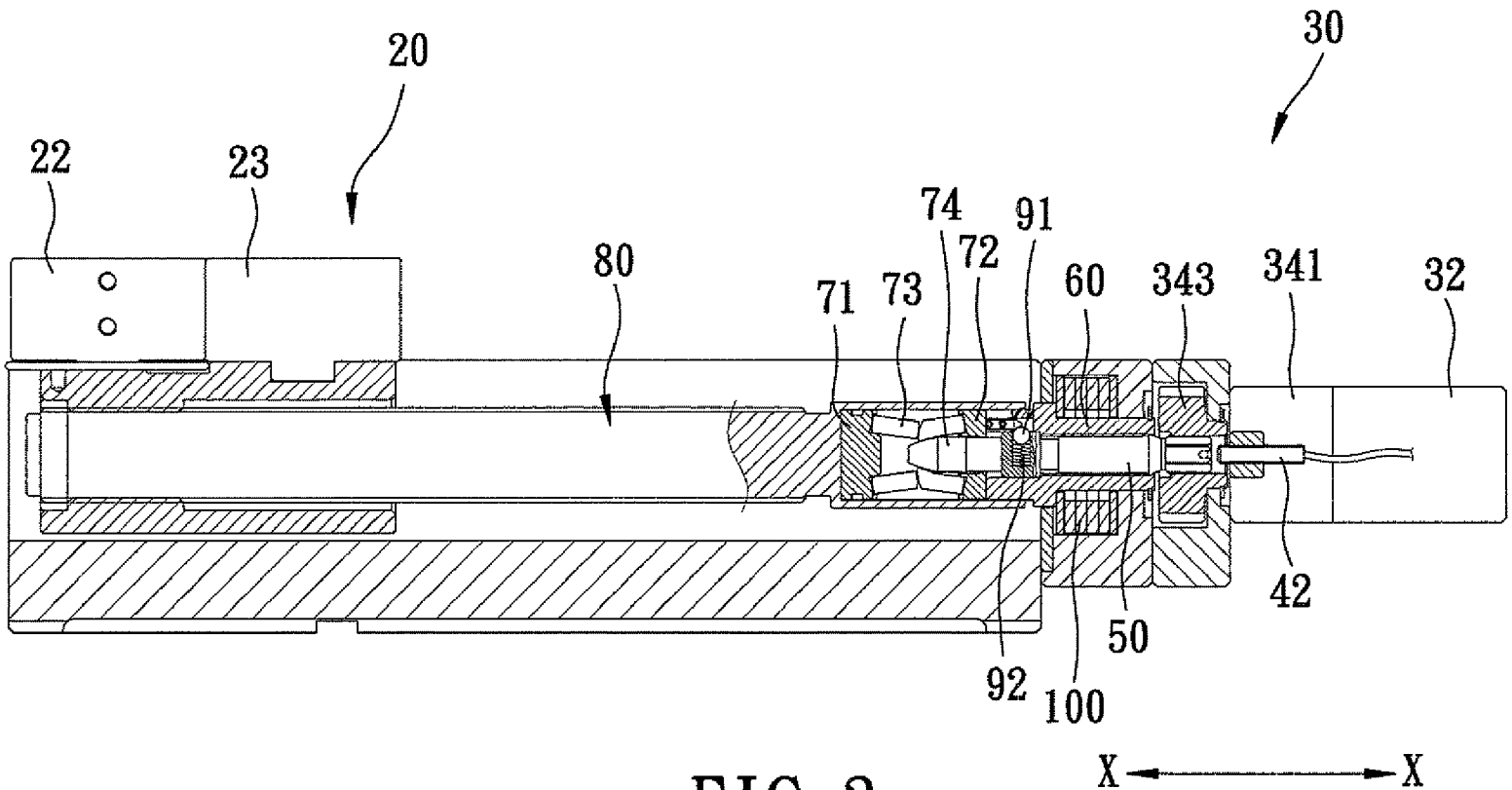
FIG. 3 is a view similar to FIG. 2, but viewed from another angle.

Referring to FIGS. 1 to 3, the preferred embodiment of a power-actuated vise apparatus according to the present invention is shown to comprise a clamping unit 20, a servo control mechanism 30, a torque transmitting member 50, and a force coupler unit.

The clamping unit 20 includes a base 21, a first jaw 22, a second jaw 23, and a carrier 24. The base 21 includes two upright walls 211 which extend in a longitudinal direction and which are spaced apart from each other in a transverse direction relative to the longitudinal direction so as to define a longitudinal slot 212 therebetween. The longitudinal slot 212 serves as a guideway 212, and has opposite first and second ends 214,215. Each of the upright walls 211 has a longitudinal groove 213 which extends in the longitudinal direction and which is communicated with the longitudinal slot 212. The first jaw 22 is secured on the base 21 proximate to the first end 214, and is adapted to permit a workpiece (not shown) to be juxtaposed thereto in the longitudinal direction. The second jaw 23 is disposed to be movable in the longitudinal direction between an engaged position, where the second jaw 23 contacts the workpiece to establish a preliminary engagement, and a disengaged position, where the second jaw 23 is spaced apart from the workpiece and is proximate to the second end 215. The carrier 24 is disposed to support the second jaw 23, and has two sliding protrusions 241 which are disposed in and which are slidable along the longitudinal grooves 213, respectively, so as to guide the carrier 24 to move along the longitudinal slot 212.

The servo control mechanism 30 includes a power supply 32 and a speed-reduction module 34 which couples the power supply 32 to the torque transmitting member 50 so as to deliver a torque force to rotate the torque transmitting member 50 at a reduced speed. The power supply 32 may be a drive motor, a magnetic actuator, a piezoelectric actuator, or the like. The speed-reduction module 34 includes a speed-reduction member 341 and gears 342,343. The torque transmitting member 50 is in splined engagement with the gear 343 so as to be rotatable about an axis in the longitudinal direction, and has a threaded segment 51.

The force coupler unit includes a driving shaft 80, a transmitting sleeve 60, a retractable retaining assembly 90, and a force multiplying mechanism 70.

The driving shaft 80 is threadedly engaged with the carrier 24, and is rotatable relative to the base 21 to generate an angular force so as to move the carrier 24 along the guideway 212 to thereby move the second jaw 23 between the engaged and disengaged positions. The driving shaft 80 has a tubular end wall 81 which is disposed opposite to the carrier 24 and which has an elongate hole 811 that extends in the longitudinal direction.

The transmitting sleeve 60 is sleeved on and is threadedly engaged with the threaded segment 51 to permit the torque transmitting member 50 to be screwed-in or screwed-out relative to the transmitting sleeve 60 by a frictional force between the transmitting sleeve 60 and the threaded segment 51, and has a front portion inserted into the tubular end wall 81 of the driving shaft 80. A screw bolt 812 is passed through the elongate hole 811 and is secured to the front portion of the transmitting sleeve 60 so as to bring the transmitting sleeve 60 into splined engagement with the driving shaft 80.

The retractable retaining assembly 90 is disposed between the torque transmitting member 50 and the transmitting sleeve 60, and provides a retaining force. The retractable retaining assembly 90 includes a ball 91 which is movable to an extending position, where the transmitting sleeve 60 is rotated with the torque transmitting member 50 when the frictional force is smaller than the retaining force, and to a retracted position where the transmitting sleeve 60 is freed from rotation with the torque transmitting member 50 when the frictional force is greater than the retaining force, and a spring 92 which is disposed to bias the ball 91 towards the extending position.

The force multiplying mechanism 70 is received in the tubular end wall 81, and is disposed between the driving shaft 80 and the transmitting sleeve 60. The force multiplying mechanism 70 includes front and rear pressing members 71,72, an actuating rod 74, a force multiplying member 73, a plurality of bolts 75, and a plurality of first biasing members 76.

The front and rear pressing members 71,72 are disposed opposite to each other in the longitudinal direction, abut against the driving shaft 80 and the transmitting sleeve 60, respectively, and are movable to be close to and away from each other.

The actuating rod 74 is driven to advance in the longitudinal direction to an actuating position by a displacement of the torque transmitting member 50 which takes place as a result of freeing of the transmitting sleeve 60 from continued rotation with the torque transmitting member 50 in the retracted position.

The force multiplying member 73 interconnects the front and rear pressing members 71,72, and is actuated by the actuating rod 74 in the actuating position to move from a normal position to a stretching position, where the force multiplying member 73 acquires a pressing force, which is applied to move the front and rear pressing members 71,72 away from each other so as to generate a linear force. In this embodiment, the force multiplying member 73 is in the form of a plurality of flexible arm pairs 731. Each of the flexible arm pairs 731 includes two linking arms which are connected to the front and rear pressing members 71,72, respectively, and which are deformable to change a distance between the front and rear pressing members 71,72 so as to be moved between the normal and stretching positions.

The bolts 75 are angularly displaced to link the front and rear pressing members 71,72. The first biasing members 76 surround the bolts 75 to bias the front and rear pressing members 71,72 towards each other so as to facilitate movement of the force multiplying member 73,78 toward the normal position.

The force coupler unit further includes a second biasing member 100 which is in the form of a plurality of spring disks to bias the transmitting sleeve 60 towards the rear pressing member 72.

The servo control mechanism 30 further includes a first sensor 42, a second sensor 43, and en electrical controller 41. The first sensor 42 confronts the threaded segment 51 of the torque transmitting member 50 along the axis, and sends a first signal when the displacement of the torque transmitting member 50 exceeds a predetermined value. The second sensor 43 is disposed to extend into the longitudinal slot 212 and proximate to the second end 215 to send a second signal when the movement of the carrier 24 exceeds a predetermined value. The electrical controller 41 is coupled to the first and second sensors 42,43 and the power supply 32. The electrical controller 41 switches off the power supply 32 upon receipt of the first signal from the first sensor 42 in the subsequent course, or upon receipt of the second signal from the second sensor 43.

Figure 4:
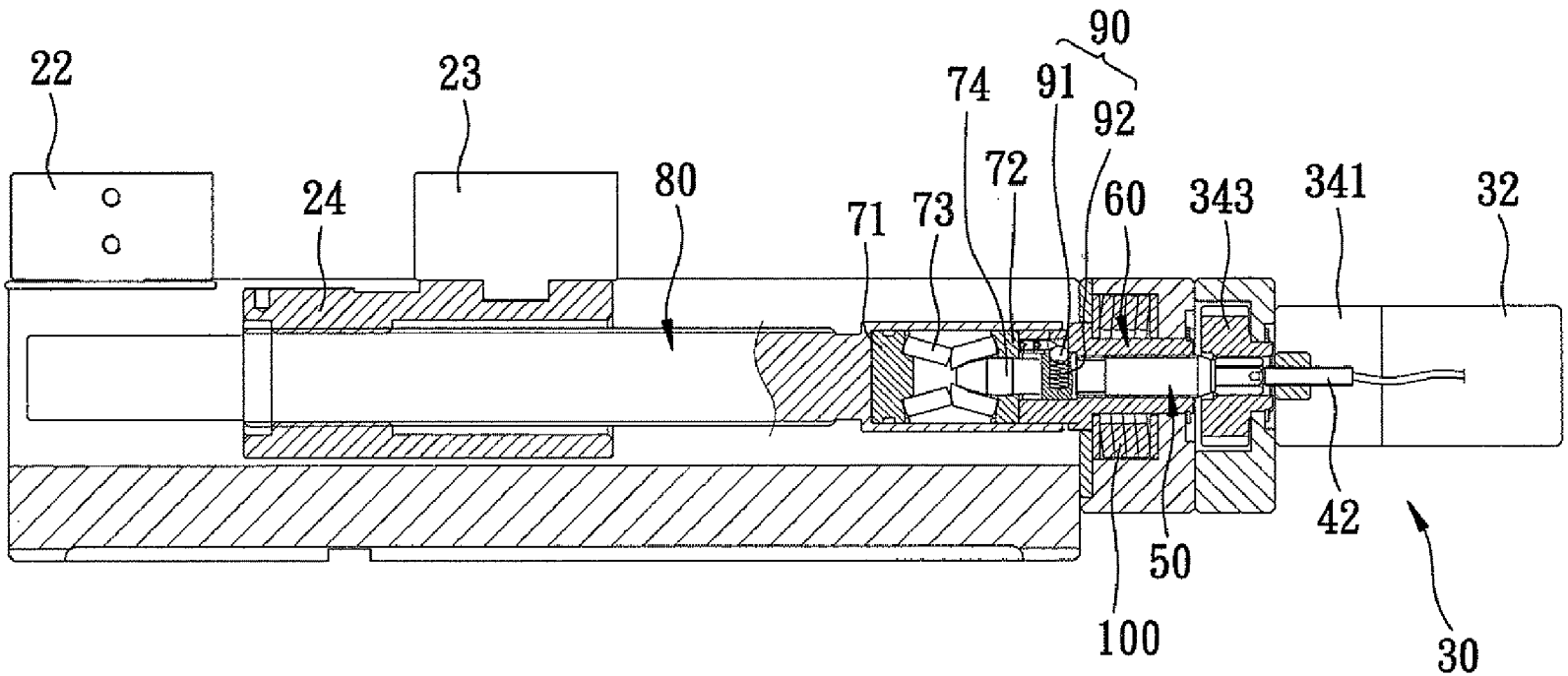
FIG. 4 is a partly sectional view of the preferred embodiment in a disengaging state.

In use, referring to FIGS. 1 and 4, when the power supply 32 is actuated to rotate the torque transmitting member 50 about the axis, the transmitting sleeve 60 is rotated by the retractable retaining assembly 90. The driving shaft 80 is rotated by means of the splined engagement with the transmitting sleeve 60 to generate the angular force so as to displace the carrier 24 and the second jaw 23 to the engaged position, i.e., toward the first jaw 22 to perform an initial course.

In a subsequent course, with reference to FIGS. 2 and 3, when the second jaw 23 contacts the workpiece (not shown) or the first jaw 22 (as shown in FIGS. 2 and 3) to establish the preliminary engagement, the rotation of the driving shaft 80 and the transmitting sleeve 60 stop while the torque transmitting member 50 is still rotated by the power supply 32. Hence, the frictional force between the transmitting sleeve 60 and the torque transmitting member 50 is increased to be greater than the retaining force such that the ball 91 is moved to the retracted position and such that the torque transmitting member 50 is screwed-out relative to the transmitting sleeve 60. As a consequence, the actuating rod 74 is moved forwards by the screwed-in movement of the torque transmitting member 50 so as to move the force multiplying member 73 to the stretching position, thereby pressing the front and rear pressing members 71,72 away from each other. Thus, the rear pressing member 72 presses the transmitting sleeve 60, which in turn compresses the second biasing member 100 to generate the linear force that is applied to the carrier 24 to tighten the workpiece against the first jaw 22.

Continued screwed-out movement of the torque transmitting member 50 is stopped when the first sensor 42 sends a first signal to the controller 41 to switch off the power supply 32. Thus, the tightening action on the workpiece is maintained even when the power supply 32 is switched off. When the power supply 32 delivers a torque force to rotate the torque transmitting member 50 in an opposite direction, the torque transmitting member 50 is screwed-in to permit the ball 91 to move to the extending position such that the transmitting sleeve 60 is rotated with the torque transmitting member 50 to drive the driving shaft 80, thereby moving the carrier 24 and the second jaw 23 back to the disengaged position. Rotation of the torque transmitting member 50 is stopped when the second sensor 43 detects the second jaw 23 and sends a second signal to the controller 41 to switch off the power supply 32.

Figure 5:
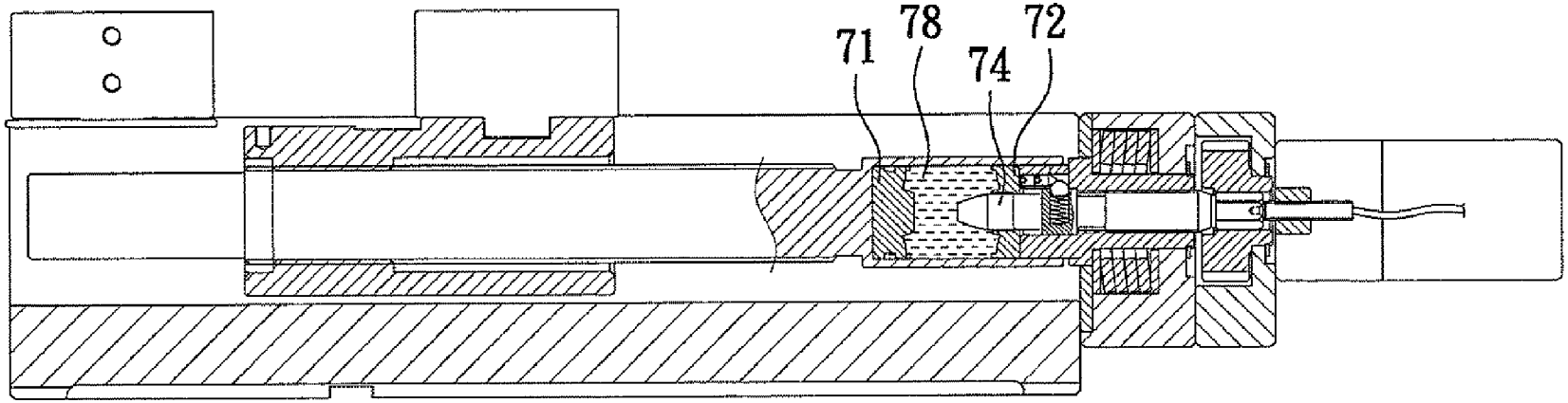
FIG. 5 is a partly sectional view of another preferred embodiment of a power-actuated vise apparatus according to this invention.

Referring to FIG. 5, in another embodiment of this invention, the force multiplying member 78 may be in the form of a fluid which is confined between the front and rear pressing members 71,72 such that, in the actuating position, the actuating rod 74 is brought to extend into the confined fluid to vest the fluid with the pressing force.

Figure 6:
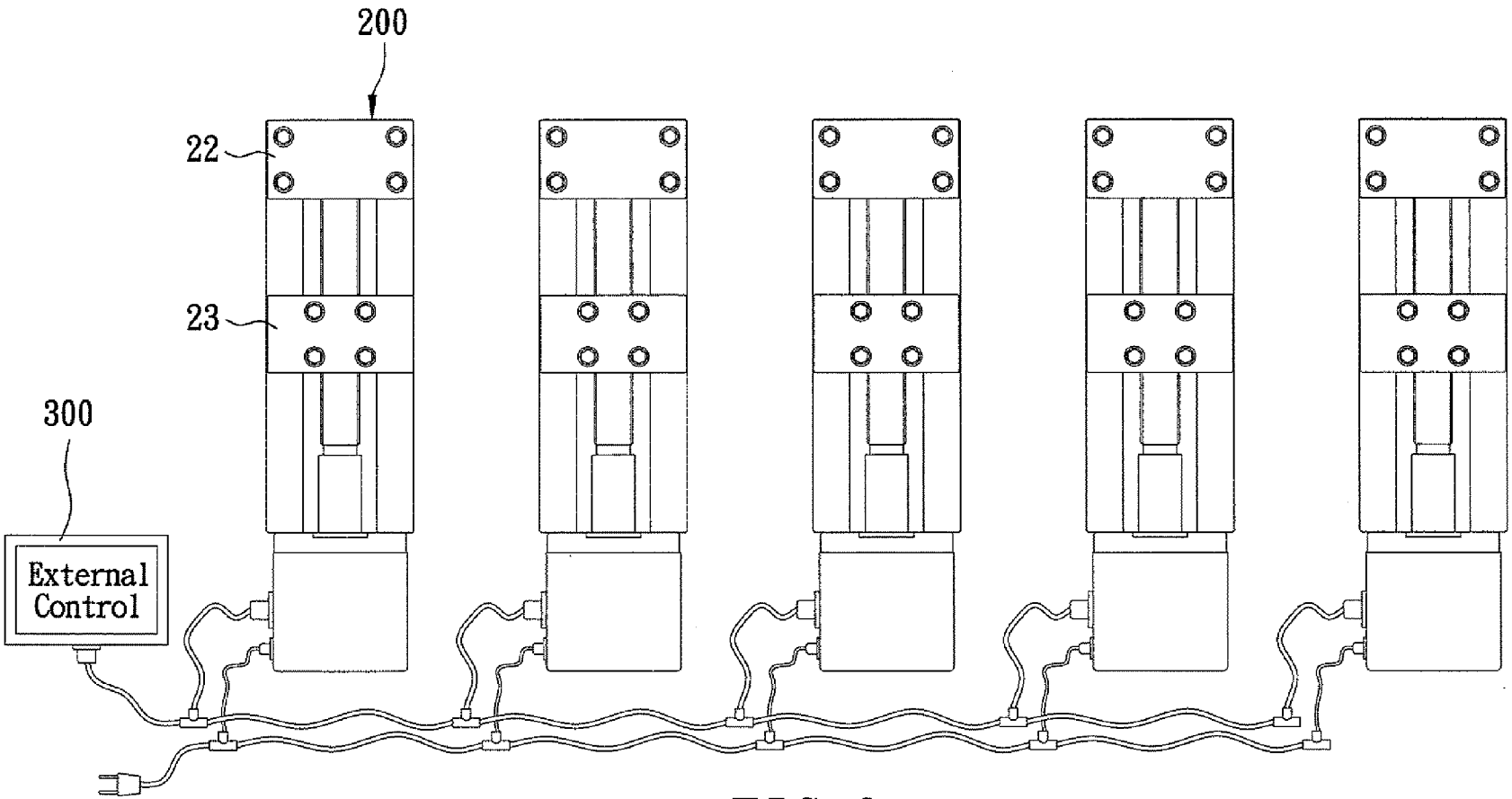
FIG. 6 is a schematic view of a vise system utilizing a plurality of vise apparatuses according to this invention.

As illustrated, the vise apparatus of this invention can be used with an automatic device to perform quick and steady operation. Also, as shown in FIG. 6, a plurality of the vise apparatuses 200 can be used, and can be controlled via a common external control 300 to construct a vise controlling system to meet requirements of automatic controlling.

While the present invention has been described in connection with what are considered the most practical and preferred embodiments, it is understood that this invention is not limited to the disclosed embodiments but is intended to cover various arrangements included within the spirit and scope of the broadest interpretations and equivalent arrangements.

I claim:

1. A power-actuated vise apparatus comprising:

a clamping unit including a base which defines a guideway that extends in a longitudinal direction and that has opposite first and second ends, a first jaw which is disposed on said base proximate to said first end, and which is adapted to permit a workpiece to be juxtaposed thereto in the longitudinal direction, a second jaw which is disposed to be movable in the longitudinal direction between an engaged position, where said second jaw contacts the workpiece to establish preliminary engagement, and a disengaged position, where said second jaw is spaced apart from the workpiece and is proximate to said second end, and a carrier which is disposed to support said second jaw, and which is configured such that said carrier is driven by an angular force to move said second jaw along said guideway between the engaged and disengaged positions in an initial course, and such that said carrier is further pressed by a linear force along the guideway in a subsequent course to bring said second jaw into tightened engagement with the workpiece from the preliminary engagement, thereby tightening the workpiece against said first jaw;

a servo control mechanism disposed to deliver a torque force;

a torque transmitting member disposed to be driven by said servo control mechanism to transmit the torque force, said torque transmitting member having a threaded segment, and being disposed to be rotatable about an axis in the longitudinal direction; and a force coupler unit configured to couple said torque transmitting member to said carrier and to take up the torque force from said torque transmitting member to result in generation of the angular force and the linear force, said force coupler unit including a driving shaft which is threadedly engaged with said carrier and which is rotatable relative to said base to generate the angular force so as to move said carrier between the engaged and disengaged positions, a transmitting sleeve which is sleeved on and which is threadedly engaged with said threaded segment to permit said torque transmitting member to be screwed-in or screwed-out relative to said transmitting sleeve by a frictional force between said transmitting sleeve and said threaded segment, and which is configured to be in splined engagement with said driving shaft, and a retractable retaining assembly which is disposed between said torque transmitting member and said transmitting sleeve and which provides a retaining force, said retractable retaining assembly being movable to an extending position where said transmitting sleeve is rotated with said torque transmitting member when the frictional force is smaller than the retaining force, and to a retracted position where said transmitting sleeve is freed from rotation with said torque transmitting member when the frictional force is greater than the retaining force.

2. The power-actuated vise apparatus according to claim 1, wherein said retractable retaining assembly includes a ball which is movable between the extending and retracted positions, and a spring which is disposed to bias said ball towards the extending position.

3. The power-actuated vise apparatus according to claim 1, wherein said force coupler unit further includes a force multiplying mechanism which is disposed between said driving shaft and said transmitting sleeve, said force multiplying mechanism including;

front and rear pressing members which are disposed opposite to each other in the longitudinal direction, which abut against said driving shaft and said transmitting sleeve, respectively, and which are movable to be close to and away from each other, an actuating rod which is driven to advance in the longitudinal direction to an actuating position by a displacement of said torque transmitting member which takes place as a result of freeing of said transmitting sleeve from continued rotation with said torque transmitting member in the retracted position, and a force multiplying member which interconnects said front and rear pressing members and which is actuated by said actuating rod in the actuating position to move from a normal position to a stretching position, where said force multiplying member acquires a pressing force which is applied to move said front and rear pressing members away from each other so as to generate the linear force.

4. The power-actuated vise apparatus according to claim 3, wherein said servo control mechanism includes a speed-reduction module which is coupled to said torque transmitting member so as to rotate said torque transmitting member at a reduced speed.

5. The power-actuated vise apparatus according to claim 4, wherein said servo control mechanism further includes a drive motor which is disposed to deliver the torque force to said torque transmitting member through said speed-reduction module.

6. The power-actuated vise apparatus according to claim 3, wherein said force multiplying member is in the form of a plurality of flexible arm pairs, each of said flexible arm pairs including two linking arms which are connected to said front and rear pressing members, respectively, and which are deformable to change a distance between said front and rear pressing members so as to be moved between the normal and stretching positions.

7. The power-actuated vise apparatus according to claim 3, wherein said force multiplying member is in the form of a fluid which is confined between said front and rear pressing members such that, in the actuating position, said actuating rod is brought to extend into said confined fluid to vest said fluid with the pressing force.

8. The power-actuated vise apparatus according to claim 3, wherein said force multiplying mechanism further includes a first biasing member disposed to bias said front and rear pressing members towards each other so as to facilitate movement of said force multiplying member toward the normal position.

9. The power-actuated vise apparatus according to claim 3, wherein said force coupler unit further includes a second biasing member which is disposed to bias said transmitting sleeve towards said rear pressing member.

10. The power-actuated vise apparatus according to claim 1, wherein said driving shaft has a tubular end wall which is disposed opposite to said carrier, and which is sleeved on said transmitting sleeve, said tubular end wall having an elongate hole which extends in the longitudinal direction, and a screw bolt which passes through said elongate hole, and which is secured to said transmitting sleeve so as to bring said transmitting sleeve into the splined engagement with said driving shaft.

11. The power-actuated vise apparatus according to claim 10, wherein said base includes two upright walls which extend in the longitudinal direction and which are spaced apart from each other in a transverse direction relative to the longitudinal direction so as to define a longitudinal slot that serves as said guideway, each of said upright walls having a longitudinal groove which extends in the longitudinal direction and which is communicated with said longitudinal slot, said carrier having two sliding protrusions which are disposed in and which are slidable along said longitudinal grooves, respectively, so as to guide said carrier to move along said longitudinal slot.

12. The power-actuated vise apparatus according to claim 1, wherein said servo control mechanism includes a speed-reduction module which is coupled to said torque transmitting member so as to rotate said torque transmitting member at a reduced speed.

13. The power-actuated vise apparatus according to claim 12, wherein said servo control mechanism further includes a drive motor which is disposed to deliver the torque force to said torque transmitting member through said speed-reduction module.

14. The power-actuated vise apparatus according to claim 13, wherein said servo control mechanism further includes a first sensor which confronts said threaded segment along the axis and which sends a first signal when the screwed-out movement of said torque transmitting member exceeds a predetermined value, a second sensor which is disposed to extend into said guideway and proximate to said second end and which sends a second signal when the movement of said carrier exceeds a predetermined value, and an electrical controller which is coupled to said first and second sensors and said drive motor, said electrical controller switching off said drive motor upon receipt of the first signal from said first sensor in the subsequent course, or upon receipt of the second signal from said second sensor.

* * * * *